United States Patent [19]

Frederiksen et al.

[11] Patent Number: 4,925,257

[45] Date of Patent: May 15, 1990

[54] SAFETY LOCK SYSTEM FOR CABINET WITH MULTIPLE DRAWERS

[75] Inventors: Bjarne Frederiksen, Villa Park, Ill.; John M. Allen, Tacoma, Wash.; Gregg W. Walla, Lake Bluff, Ill.

[73] Assignee: Timberline Supply Ltd., Lake Bluff, Ill.

[21] Appl. No.: 290,571

[22] Filed: Dec. 27, 1988

[51] Int. Cl.[5] ..... E05C 7/06

[52] U.S. Cl. ..... 312/221

[58] Field of Search ..... 312/216–221

[56] References Cited

U.S. PATENT DOCUMENTS

| | | | |
|---|---|---|---|
| 3,404,929 | 10/1968 | Wright et al. | 312/216 |
| 3,969,008 | 7/1976 | Pergler | 312/221 |
| 4,480,883 | 11/1984 | Young | 312/221 |
| 4,637,667 | 1/1987 | Reid et al. | 312/221 X |
| 4,711,505 | 12/1987 | Lakso | 312/221 X |
| 4,820,002 | 4/1989 | Lechner et al. | 312/221 |
| 4,838,624 | 6/1989 | Walla | 312/221 |

*Primary Examiner*—Joseph Falk

*Attorney, Agent, or Firm*—Wood, Phillips, Mason, Recktenwald & Vansanten

[57] ABSTRACT

An improvement is provided in a piece of furniture having a cabinet with first and second drawers, each selectively slidable relative to the cabinet between an open position and a closed position. The improvement comprises a lock bar mounted to the cabinet for translatory movement relative to the cabinet in first and second opposite directions between first and second positions, and cooperating structure on the lock bar and first and second drawers for preventing simultaneous movement of the first and second drawers from their closed position to their open position.

14 Claims, 3 Drawing Sheets

FIG. 7A
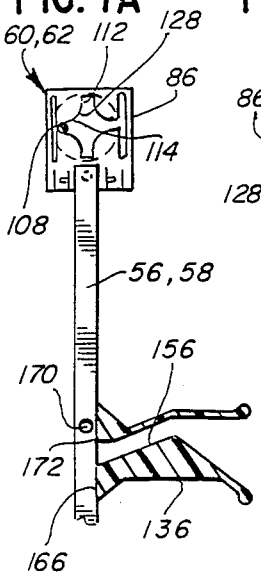
FIG. 7B
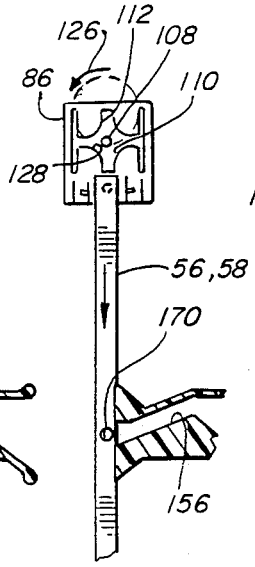
FIG.7C
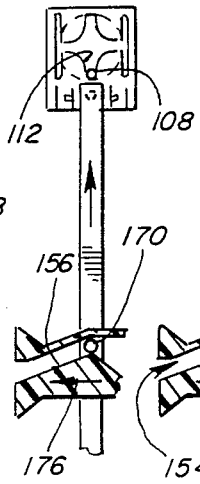
FIG. 7D
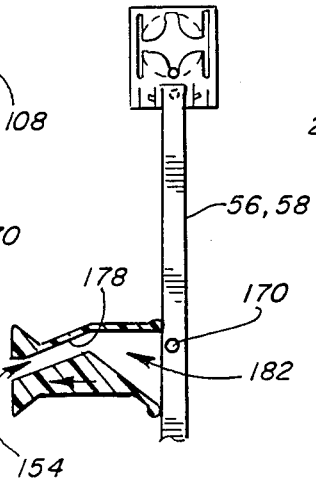
FIG. 7E
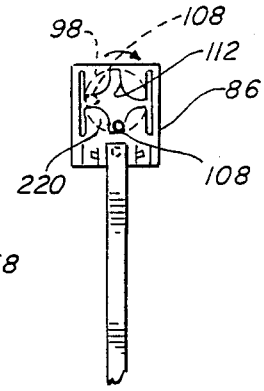
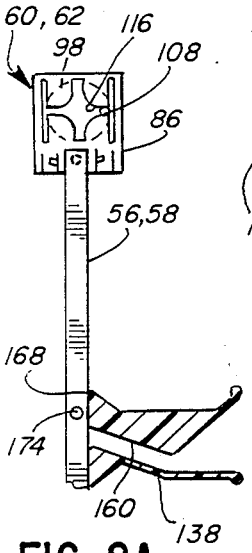
FIG. 8A
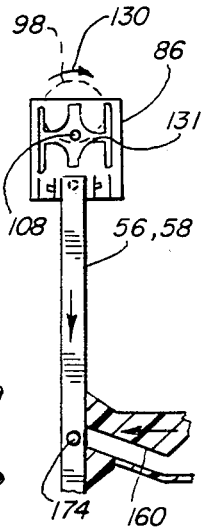
FIG.8B
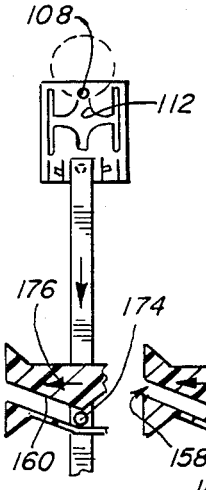
FIG.8C
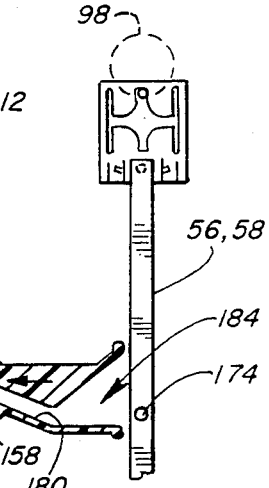
FIG. 8D
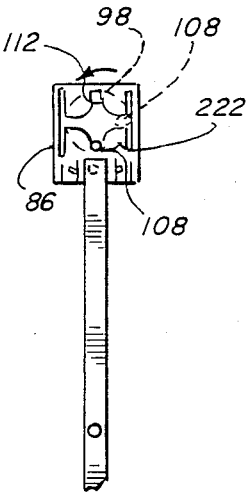
FIG. 8E
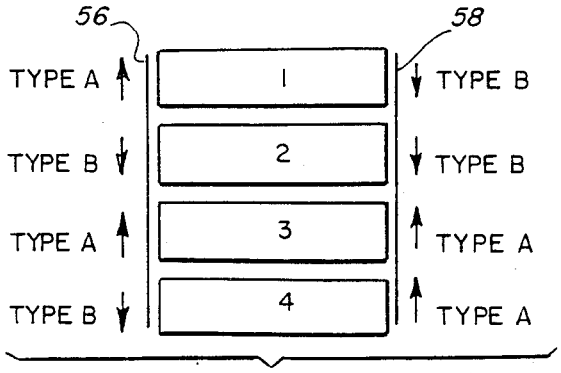
FIG. 9

SAFETY LOCK SYSTEM FOR CABINET WITH MULTIPLE DRAWERS

BACKGROUND OF THE INVENTION

1. Field of the Invention

This invention relates to a locking system for a plurality of drawers on a piece of furniture and, more particularly, to structure for preventing simultaneous opening of more than one drawer.

2. Background Art

It is known to provide structure to prevent opening of more than one drawer at a time on a piece of furniture. The purpose of this is to prevent the cabinet from becoming front heavy and tipping as might potentially cause injury to the user. In U.S. Pat. No. 3,404,929, to Wright et al, a cabinet with a plurality of vertically arranged drawers and such a safeguard is disclosed. Each drawer carries a plate which, upon the drawer being opened, deflects a lug on a translatable locking bar to reposition the locking bar so that the locking bar prevents opening of any of the other drawers.

The principal drawback with the Wright et al structure is that it can be defeated by simultaneously opening two drawers. While a user normally would not simultaneously open the drawers, a plurality of drawers may be simultaneously shifted open as during an earthquake. Further, for furniture to meet BIFMA standards, the ability to simultaneously open drawers cannot be present. The Wright et al structure would thus not meet BIFMA standards.

One solution to the above problem is disclosed in U.S. Pat. No. 4,711,505, to Lakso. Lakso utilizes a line of balls in a slotted guide member. An actuator, associated with each drawer, causes a ball to be forced between balls in the slot as an incident of the drawer being opened. The balls are packed sufficiently tightly in the slot that only one ball can be forced between adjacent balls in the line. Resultingly, simultaneous opening of more than one drawer is prohibited.

However, the Lakso structure has numerous drawbacks. First, the actuators have to be separately, manually repositioned by a user in both assembling and removing the drawers. That is, as one drawer is put in place and closed, the actuator associated with the next drawer must be manually set to allow entry of the next drawer into its receptive opening and proper engagement between the next drawer and actuator. If any drawer is assembled with the actuator improperly positioned, damage to the drawer and/or actuator could occur.

The balls and the member defining the slot must be dimensioned to very close tolerances for the structure to operate properly in Lakso. The Lakso structure is thus very dirt sensitive. In the event of any foreign matter finding its way into the slot, the Lakso structure could malfunction. Additionally, even slight distortion of the member defining the ball retention slot could result in malfunction.

The Lakso structure also requires the inventorying and assembly of numerous parts. In the described embodiment, the balls are small and difficult to handle, which complicates assembly, resulting in significant manufacturing costs which must be passed on to the consumer.

Because of the relatively large size of the member in Lakso defining the ball retention slot, a substantial amount of the cabinet must be cut out to recess that member.

The Lakso structure is also very sensitive to drawer movement. That is, if one of the drawers is slightly ajar, the remainder of the drawers may be blocked from opening. This is particularly a problem if the cabinet for the drawers is placed on a non-level supporting surface.

Another problem with the Lakso structure is that there is a limited amount of adjustment possible for the mechanism. Each actuator is adjustable vertical only in increments equal to the diameter of the balls. Fine adjustments to the actuator cannot be made without readjusting the entire member defining the ball receiving slot, which member is intended to be permanently mounted. Alternatively, the pin on the drawer can be relocated, however the drawer is usually made from relatively thin stock, which makes such adjustment difficult and undesirable due to stripping out of the screws.

SUMMARY OF THE INVENTION

Applicants' invention is specifically directed to overcoming the above enumerated problems in a novel and simple manner.

According to the invention, an improvement is provided in a piece of furniture having a cabinet with first and second drawers, each of which is selectively slidable relative to the cabinet between an open position and a closed position. The improvement comprises a lock bar mounted to the cabinet for translatory movement relative to the cabinet in first and second opposite directions between first and second positions, and cooperating structure on the lock bar and first and second drawers for preventing simultaneous movement of the first and second drawers from their closed position to their open position.

More particularly, the cooperating structure consists of first and second lugs on the lock bar and first and second ramp plates on the first and second drawers respectively, each of which ramp plates has a ramp surface and a blocking surface. One of the lugs resides in the path of one of the ramp surfaces on one of the ramp plates upon one drawer carrying the one ramp plate being moved from its closed position towards its open position with the other drawer in its closed position so as to thereby cause the lock bar to be deflected into its first position, wherein the other of the lugs blocks the blocking surface on the other of the ramp plates on the other drawer to prevent opening of the other drawer. The other lug resides in the path of the other ramp surface on the other ramp plate upon the other drawer being moved from its closed position towards its open position with the one drawer in its closed position to thereby cause the lock bar to be deflected into its second position, wherein the one lug blocks the blocking surface on the one ramp plate to prevent opening of the one drawer.

In a preferred form, the lock bar and associated lugs move as a unitary structure. The remainder of the lock mechanism is stationary. Accordingly, the structure is simple, requires few parts to be inventoried and assembled, and affords a reliable mechanism to prevent opening of more than one drawer at a time.

In a preferred form, the lock bar is mounted for translatory movement in a substantially vertical line between the first and second positions.

Further, structure is provided for selectively locking the position of the lock bar to thereby prevent opening of any of the drawers and unlocking the lock bar to permit movement of the lock bar between the first and second positions therefor in response to one of the drawers being opened.

Preferably, the locking structure in the prior paragraph consists of a slide plate guided for movement in a reciprocative path between a locked position and an unlocked position, structure for connecting the lock bar to the slide plate so that the lock bar follows reciprocative movement of the slide plate between a neutral position, between the first and second positions for the lock bar corresponding to the unlocked position for the slide plate, and one of the first and second positions corresponding to the locked position for the slide plate, and a crank element mounted for rotation about a first axis and having a pin offset from the first axis and movable in a T-shaped slot in the slide plate, which T-shaped slot consists of a stem leg and a cross-bar leg. Rotation of the crank element causes the pin to be guided in the slot and resultingly moves the slide plate in a prescribed fashion. The pin resides at the juncture of the slot legs with the slide plate in its unlocked position and resides in the stem leg with the slide plate in its locked position. The pin travels in opposite directions in the slot cross-bar in response to movement of the lock bar in the first and second directions between the first and second lock bar positions.

Structure is provided to permit rotation of the crank element relative to the slide plate without moving the slide plate with the lock bar in one of its first and second positions and both drawers closed, to thereby prevent jamming of the locking mechanism.

Cooperating structure is provided on the slide plate and channel to maintain the lock bar in each of one of the first and second positions therefor and a neutral position between said first and second position. Preferably, the cooperating structure is integrally formed with the channel and defines a recess. The cooperating structure on the slide plate consists of a bendable leg for nesting in the recess and biased towards the recess with the lock bar in one of its first and second positions and said neutral position. To insure positive driving of the leg into the recess, structure is provided to increase the bias on the leg.

The aforementioned locking arrangement can be utilized with any number of drawers. With more than two drawers, a second lock bar is used. The first and second lock bars are both mounted to the cabinet for vertical translatory movement between first and second positions, with each lock bar having a neutral position between its first and second position. The number of lugs on each lock bar is equal to the number of drawers. Each drawer has a ramp plate on each of its sides with each plate having a ramp surface and a blocking surface. The ramp plates and locking bars/lugs cooperate in the same manner as they do in the aforementioned two drawer cabinet arrangement. However, the ramp surfaces are so arranged that upon any one of the multiple drawers being opened at least one of the ramp plates on the remainder of the drawers is blocked by a lug on one of the lock bars.

To assemble the drawers on the cabinet, each drawer can be simply moved into its operative position and closed. There is no need for the assembler to manually manipulate any structure within the cabinet.

It is also possible to readily, infinitely adjust the lugs on the lock bars and/or the position of the lock bar on its guide element. The lock bar and associated guide structure is preferably made from metal so that the adjustments can be made repeatedly without damage to the locking system.

Further, the guiding structure for the lock bar can be relatively simple and unobtrusive so that only a small recess need be provided in the cabinet to accept the same.

Further, the lock bar is not dirt sensitive as are certain prior art structures. Consequently, considerable tolerance is built into the system.

The inventive structure can also be arranged so that one of the drawers must be moved out on the order of ¼ inch or more to cause the other drawers to be locked in a closed position. Thus, in the event that the cabinet is on a non-level surface and tipped slightly forwardly, the slight resulting shifting of the drawers will not prevent the drawers from being opened.

Other objectives and advantages of the present invention will be apparent from the following detailed description, the drawings and the appended claims.

BRIEF DESCRIPTION OF THE DRAWINGS

FIGS. 7A–7E show schematically the cooperation between the locking module in FIG. 2, the lock bar and the ramp plate in FIG. 5 in five different relative positions;

FIG. 7A depicts a drawer in closed position and the locking module locked;

FIG. 7B depicts the drawer in a closed position and the locking module unlocked;

FIG. 7C depicts the drawer partially opened;

FIG. 7D depicts the drawer sufficiently open that the ramp plate clears the lock bar;

FIG. 7E demonstrates the transition out of a jammed position for the locking module with the drawer closed and inadvertently locked;

FIGS. 8A–8E show schematically the cooperation between the locking module in FIG. 2, the lock bar and the ramp plate in FIG. 6 in five different relative positions;

FIG. 8A depicts a drawer in closed position and the locking module unlocked;

FIG. 8B depicts the drawer in a closed position and the locking module unlocked;

FIG. 8C depicts the drawer partially opened;

FIG. 8D depicts the drawer sufficiently open that the ramp plate clears the lock bar;

FIG. 8E demonstrates the transition out of a jammed position for the locking module with the drawer closed and inadvertently locked; and FIG. 9 is a schematic representation of a preferred arrangement for the ramp plates in FIGS. 5 and 6 on the drawers on a four drawer cabinet.

DETAILED DESCRIPTION OF THE DRAWINGS

Figure 1:
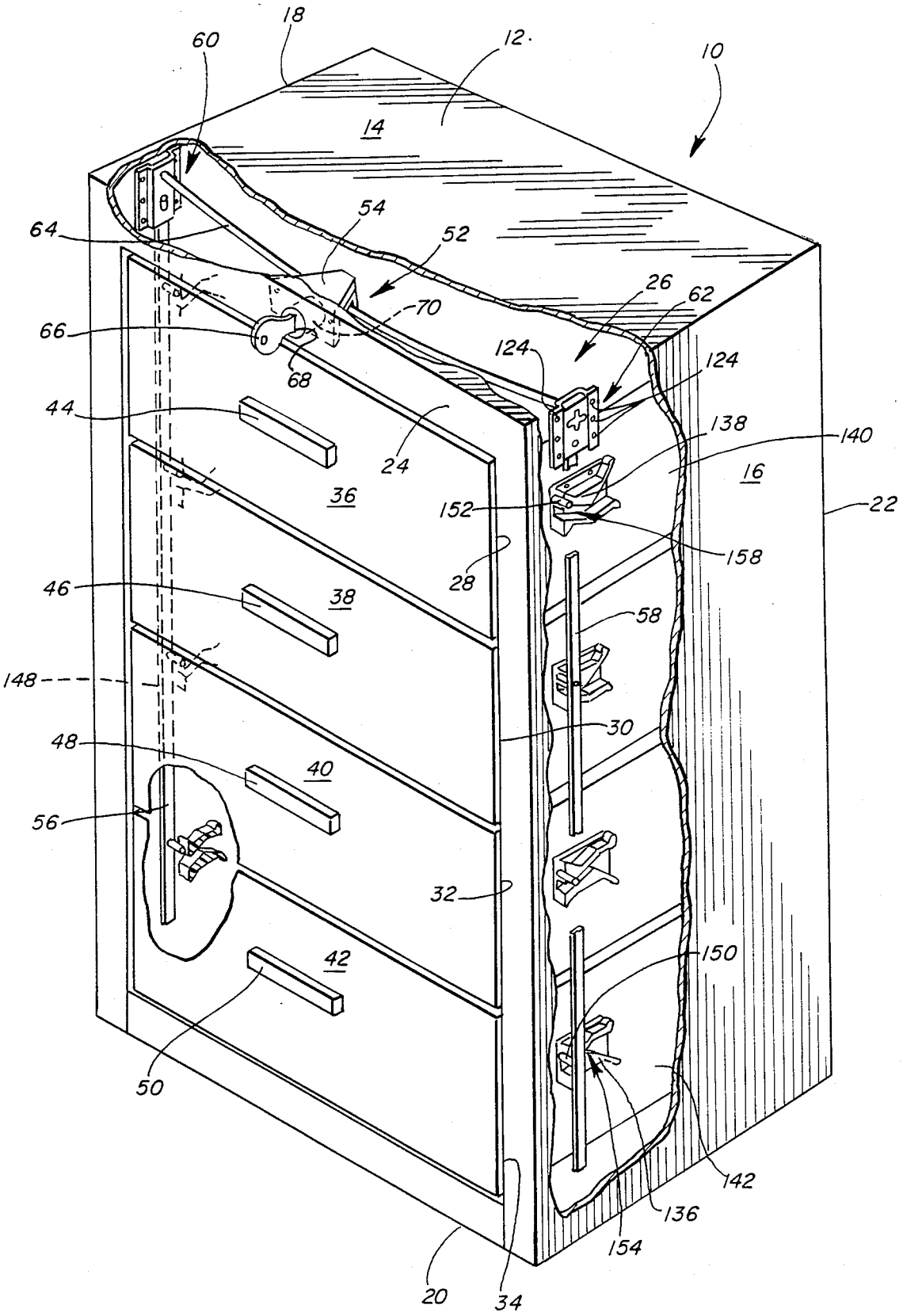
FIG. 1 is a perspective view of a piece of furniture incorporating drawer locking system according to the present invention.

A cabinet suitable for incorporation of a locking system according to the present invention is shown at 10 in FIG. 1. The cabinet in FIG. 1 is only exemplary of one type of furniture piece to which the present invention can be adapted. Briefly, the cabinet 10 has a frame 12 with a top wall 14, oppositely facing side walls 16, 18, a bottom wall 20, a rear wall 22 and front wall 24, all of which cooperatively bound a storage space 26. The front wall 24 has four vertically spaced openings 28, 30, 32, 34 therein to consecutively accept conventional-style drawers 36, 38, 40, 42. The drawers 36, 38, 40, 42 are guided on conventional structure (not shown) for sliding movement in a fore and aft direction between the closed position in FIG. 1 and an open position, wherein the drawers are translated forwardly from their FIG. 1 position Pulls 44, 46, 48, 50 are provided to facilitate a user's manipulation of the drawers 36, 38, 40, 42.

The locking system according to the present invention is shown generally at 52 and has an operator module 54, which is used to control the position of two separate lock bars 16, 58 on opposite sides of the cabinet 10, and a locking module at 60, 62, associated with lock bars 56, 58 respectively. The operator module 54, through a cable 64, simultaneously operates the locking modules 60, 62 to thereby selectively control the position of the lock bars 56, 58. The operator module 54 is operated through a key 66 in a conventional keyway 68 on a lock cylinder 70 exposed at the front of the cabinet 10.

Description herein of the details of operation of the module 54 is not necessary to understand the present invention. An exemplary module 54 is described fully in U.S. Pat. No. 4,609,233, to Walla, assigned to the assignee of this application. It suffices to say that the operator module 54, upon the key 66 being rotated, imparts rotation to the cable 64 about its length. The cable rotation is converted by the locking modules 60, 62 to vertical translatory movement of the lock bars 56 58.

Figure 2:
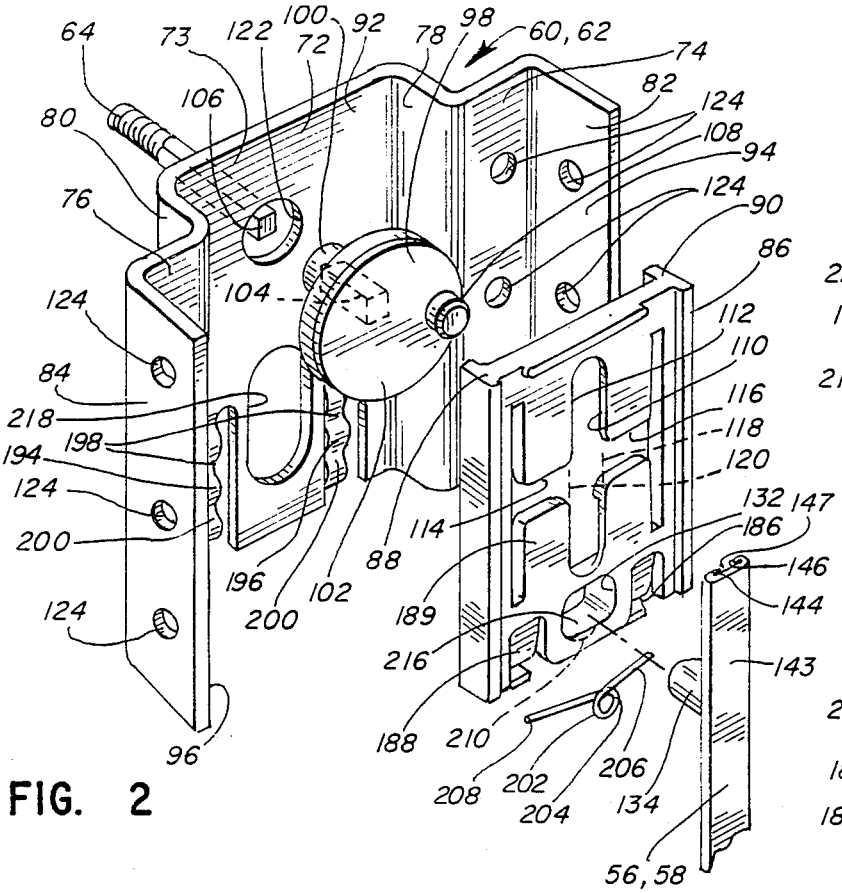
FIG. 2 is an enlarged, exploded perspective view of a locking module for a lock bar associated with the locking system of FIG. 1.
Figure 3:
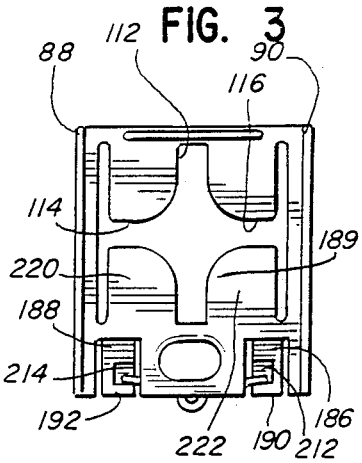
FIG. 3 is a side elevation view of a slide plate associated with the locking module of FIG. 2.
Figure 4:
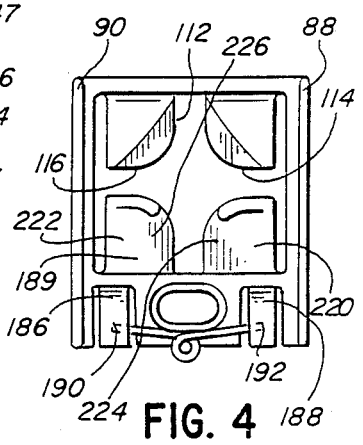
FIG. 4 is an elevation view of the slide plate from the side opposite that in FIG. 3.

The details of the locking modules 60, 62 are shown clearly in FIGS. 2–4. The depicted locking modules 60, 62 are no-handed; that is, they are identical and useable on either side of the cabinet 10 Each locking module 60, 62 consists of a channel 72 formed from sheet metal material. The channel has a body 73 with a generally U-shaped configuration with spaced mounting walls 74, 76 turned at right angles to the legs 78, 80 of the body 73 and retention flaps 82, 84 integrally formed on the walls 74, 76. The U-shaped body 73 of the channel 72 is configured to guide vertical translatory movement of a slide plate 86. The slide plate 86 has an I-shaped cross-sectional configuration with the cross bars 88, 90 of the I bearing directly against the flat surface 92 at the base of the body 73. The slide plate 86 is confined in a fore and aft direction by the channel legs 78, 80. With the slide plate 86 operatively positioned against the channel body 73, the retention flaps 82, 84 are folded towards the walls 74, 76, respectively, so that the surfaces 94, 96 on the flaps 82, 84, respectively, capture the slide plate 86 in conjunction with the body surface 92.

Before the slide plate 86 is put in place, a crank element 98 is assembled. The crank element 98 has a cylindrical base 100 and an integrally formed, concentric, enlarged disk 102. The base 100 has a bore 104 which makes keyed connection with a squared end 106 of the cable 64.

There is a pin 108 bn the crank element 98 offset from the axis of the base 100 and associated disk 102, which pin 108 moves in a cross-shaped slot 110 in the slice plate 86. The slot 110 is configured to make the slide plate 86 a universal, i.e. righthand/lefthand, configuration. In the simplest form, however, the slot is simply T-shaped with a cross bar leg 112 and a stem leg, either shown as 114 or 116, depending upon whether the slide plate 86 is to be right- or lefthanded. If the slot leg 114 is to be utilized, slot leg 116 can be eliminated so that the slide plate 86 would be solid to the right of the dotted line 118. Alternatively, with slot leg 116 utilized, slot leg 114 can be eliminated by making the slide plate 86 solid to the left of the dotted line 120. The significance of this will be apparent from the description of FIGS. 7A–8E, which follows.

The base 100 of the crank element 98 is directed through and journalled for rotation within a bore 122 in the channel body 73. The slide plate 86 maintains the crank element 98 captively against the channel 72. with the retention flaps 82, 84 folded toward the mounting walls 74, 76, the channel 72, crank element 98, and slice plate 86 operate as a self-contained module, which can be fastened to the furniture cabinet 10 through conventional screws (not shown) extended through bores 124 in the overlapping walls 74, 76 and flaps 82, 84.

With the modules 60 62 assembled, the pin 108 extends into the slot 110. By rotating the crank element 98, the pin 108 moves in the slot 110 and effects translation of the slide plate 86. In FIG. 7A the locked position for the slide plate 86 is shown The pin 108 resides in the stem leg 114 and the crank element 98 is fixed against rotation by the operator module 54. Resultingly, the slide plate 86 cannot translate. Upon the operator module 54 being reset and the crank element 98 rotated in a counterclockwise direction, as indicated by arrow 126 in FIG. 7B, through 90°, the pin 108 bears against a curved edge 128 of the slide plate 86, thereby urging the slide plate 86 downwardly until the pin 108 resides in a neutral position in FIG. 7B at the juncture of the stem log 114 and cross bar leg 112. The slide plate 86, in the FIG. 7B position, is free to translate vertically upwardly and downwardly relative to the crank element 98, for reasons that will be explained below.

FIGS. 8A and 8B depict the positions for the crank element 98 and slide plate 86 corresponding to that in FIGS. 7A and 7B respectively, but show opposite-handed operation. That is, the pin 108 in FIG. 8A resides in stem leg 116 in the locked position for the operator module 54 and moves to the FIG. 8B position, which is the same as the FIG. 7B position, by counterclockwise rotation of the crank element 98 relative to the slide plate 86, as shown by the arrow 130 in FIG. 8B, in the process bearing against curved slide plate surface 131, to thereby shift the slide plate 86.

The slide plate 86 has a through opening 132 to accept a cylindrical projection 134 on the lock bar 56, 58. The projection 134 is extendable through the opening 132 and is drawn by the slide plate 86 as the slide plate B6 is moved by the crank element 98. The opening 132 is oval in configuration so as to provide tolerance in a fore and aft direction.

The principal objective of the present invention is to prevent opening of more than one drawer at a time and, preferably, to prevent simultaneous opening of more than one drawer. To accomplish this, ramp plates 136, 138 are provided on the drawers 36, 38, 40, 42. One ramp plate 136, 138 is provided on each drawer side. The ramp plates 136, 138 cooperate with the lock bars 56, 58 to accomplish the above objective.

Figure 5:
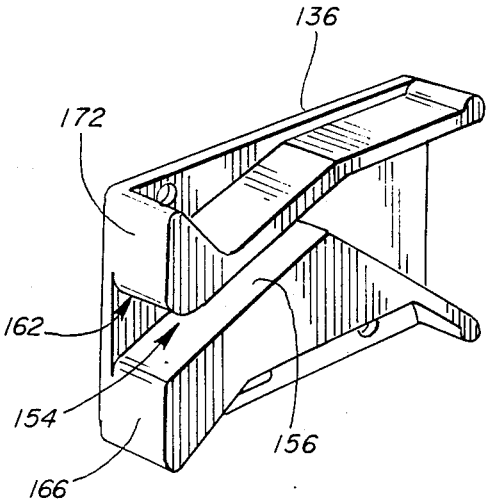
FIG. 5 is an enlarged, perspective view of one type of ramp plate for guiding movement of the lock bar on the cabinet.
Figure 6:
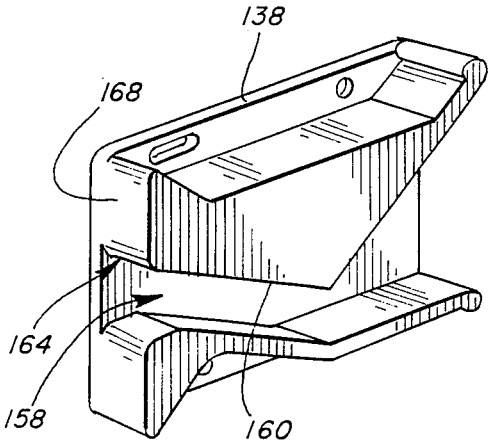
FIG. 6 is an enlarged perspective view of another type of ramp plate for guiding movement of the lock bar on the cabinet.

The simplest form of the invention will first be described with respect to the cabinet 10 in FIG. 1 with the assumption, for purposes of illustration, that only two drawers, 36, 42 are present. In the event of a two-drawer cabinet, only one lock bar 56, 58 is required and for purposes of this description, lock bar 58 will described. The top drawer 36 has a ramp plate 138, as shown in FIG. 6, while the bottom drawer 42 has a ramp plate 136, as shown in FIG. 5. The ramp plates 136, 138 are provided on the side walls 140, 142 of the drawers 36, 42, respectively. The lock bar 58, which is mounted on the cabinet side wall 16, is preferably formed from an elongate strip of metal and has a body 143, with legs 144, 146 doubled back against the body 143 and having spaced ends defining a slot 147. The lock bar 58 is guided for vertical translatory movement within a recessed slot 148 in the cabinet side wall 16. The slot 148 is shown in FIG. 1 in the cabinet side wall 18. The slot 148 is located so that the lock bar 58 resides at the front of the ramp plates 136, 138 on the drawers 36, 42.

The lock bar 58 has a lug 150 projecting laterally inwardly immediately in front of the ramp plate 136 and a lug 152 projecting laterally inwardly immediately in front of the ramp plate 138, with the drawers 36, 42 closed. With the operator module 54 in an open position, the lug 150 is vertically aligned with a passageway 154 in the ramp plate 136 which passageway 154 permits the lug 150 to pass through the ramp plate 136. Provision is made to adjust the position of the lug 150, and other lugs described below, relative to the lock bar 58. The lug 150 is vertically aligned with a ramp surface 156 on the ramp plate 136, which surface 156 is inclined upwardly from front to rear on the ramp plate 136. Upon the drawer 42 being opened, the ramp surface 156 deflects the lock bar vertically upwardly.

The lug 152 is similarly aligned with a passageway 158 in the ramp plate 138 with the drawers 36, 42 closed and the operator module 54 in an unlocked position. The ramp plate 138 has a downwardly facing ramp surface 160 which abuts the lug 152 upon the drawer 36 being opened and thereby deflects the lock bar 58 vertically downwardly.

In operation, with both drawers 36, 42 closed and the operator module 54 unlocked, the lugs 150, 152 reside at the entries 162, 164 to passageways 154, 158 respectively. If the top drawer 36 is opened, the lug 152 encounters the ramp surface 160 on the ramp plate 138 to shift the lock bar 58 downwardly so as to situate the lug 150 in horizontal alignment with a forwardly facing blocking surface 166 on the ramp plate 136. Any attempt to open drawer 42 after drawer 36 is opened would bring lug 150 against the surface 166 to block forward movement of drawer 42.

Similarly, if drawer 52 is opened, with drawer 36 closed, lug 150 will ride up ramp surface 156 on ramp plate 136 to situate the lug 152 in horizontal alignment with a forwardly facing blocking surface 168 on the ramp plate 138, thereby preventing opening of the drawer 36. If one attempts to simultaneously open drawers 36 and 42, the lugs 152, 150 will be jammed between the ramp surfaces 156, 160 so that neither drawer 36, 42 can be opened.

If more than two drawers are provided, two lock bars 58, 60 are used, as shown in FIG. 1. A ramp plate 136, 138 is provided on each side of each drawer 36, 38, 40, 42 for cooperation with a lug on the lock bars 58, 60. The principal of operation is the same, whether there are two drawers or any number of drawers in excess of two. If more than two drawers are provided, location of the different types of ramp plates 136, 138 is coordinated so that upon any drawer being opened, the blocking surface 166, 168 on at least one of the ramp plates 136, 138 on each of the drawers 36, 38, 40, 42 is horizontally aligned with a lug on the lock bar 58, 60.

To simplify this description, the ramp plate 136, in the FIG. 5 orientation, will be characterized as a type A ramp plate, which deflects the lock bar lugs upwardly in response to its associated drawer being opened, whereas the type B ramp plate 138, in the FIG. 6 orientation, deflects the lugs downwardly in response to its associated drawer being opened. The invention contemplates that the ramp plates 136, 138, shown in FIGS. 5 and 6 in an orientation to be placed on one side of the drawers 36, 38, 40, 42, can be inverted from their FIGS. 5 and 6 orientation for placement on the other side of the drawers 35, 38, 40, 42. By inverting the plates, the type A plates become type B plates and vice versa. In FIG. 9, a four drawer cabinet is depicted schematically and one preferred arrangement of ramp plates 136, 138 on the drawer sides is shown. If, for example, in FIG. 9, drawer 2 is opened, the type B ramp plate on the right side of the cabinet 10 will deflect the lock bar 58 downwardly and the type B ramp plate on the left side of the cabinet 10 will deflect the lock bar 56 downwardly. Simultaneous opening of any two drawers in FIG. 9 would be permitted only if the ramp plate types are matched on both sides of the drawer. If one attempts to simultaneously open drawers 1 and 2, the ramp plates on the left side of those two drawers are incompatible. Simultaneous opening of drawers 2 and 3 is prevented by the incompatibility of the ramp plates on both sides of the drawers, and simultaneous opening of drawers 2 and 4 is prevented by the incompatibility of the ramp plates on the right side of these drawers.

Reference will now be made to FIGS. 7A–8E to describe the relative movement between the crank element 98, slide plate 86 and lock bars 56, 58 in operation. In FIGS. 7A–7D, a type A plate 136 is shown. In FIG. 7A the operator module 54 is locked and a lug 170 on the lock bar 56, 58 is situated in horizontal alignment with a blocking surface 172 on the plate 136. FIG. 8A depicts the same locked position as in FIG. 7A with the locking module 60, 62 on the opposite drawer side as the module 60, 62 in FIG. 7A. A type B ramp plate 138 is shown. In the locked position of FIG. 8A, a lug 174 on the lock bar 56, 58 is horizontally aligned with the blocking surface 168 on the ramp plate 138. All drawers are thus prohibited from being moved from their closed position to their open position. Upon rotation of the crank element 98 through the key 66 in a counterclockwise direction in FIG. 7B and a clockwise direction in FIG. 8B, the pin 108 moves to its neutral position. In the neutral position, any one of the drawers can be opened. Forward movement of any drawer 36, 38, 40, 42, as indicated by arrow 176 in FIGS. 7C and 8C, causes the lug 170 to travel up the ramp plate 156 so that the lock bar 56, 58 and slide plate 86 shift upwardly and the pin 108 resides at the bottom of the cross bar leg 112, as in FIG. 7C. In FIG. 8C, drawer opening causes the lug 174 to bear against the ramp surface 160 so that the lock bar 56, 58 is shifted downwardly relative to the crank element 98 and the pin 108 resides at the top of the cross bar leg 112, as in FIG. 8C. In FIG. 7D, the lug 172 is shown passed entirely through the passageway 154. In FIG. 8D, the lug 174 is shown passed entirely through the passageway 158. Further forward movement of the drawer associated with the ramp plates 136, 138 effects no further shifting of the lock bar 56, 58 from the FIGS. 7D and 8D positions.

Upon the drawer associated with the ramp plate 136 in FIGS. 7A–7D being closed, the lug 172 encounters a downwardly facing surface 178 on the ramp plate 136, which thereby deflects the lug 172 and lock bar 56, 58 downwardly to the neutral position in FIG. 7B. Closing of the drawer carrying the ramp plate 138 in FIGS. 8A–8D causes the lug 174 to encounter an inclined, upwardly facing surface 180 on the ramp plate 138, which shifts the lug 174 and associated lock bar 56, 58 upwardly to the FIG. 8B neutral position for the look bar 56. 5B. The rear opening 182 to the passageway 154 is V-shaped to guide the lug 172 consistently against the surface 178. Similarly, the opening 184 in the ramp plate 138 guides the lug 174 consistently against the surface 180 as the drawer is closed.

It is another aspect of the invention to provide a simple structure that positively maintains the slide plate 86 in one of its opposite extremes of travel and the neutral position between the opposite extremes of travel. As seen clearly in FIGS. 2–4, the slide plate 86 has legs 186, 188 integrally formed with the slide plate 86 and depending from the body 189 of the plate 86 in cantilever fashion The legs 186, 188 have curved noses 190, 192, respectively, which ride against legs 194, 196 respectively, stamped from the U-shaped body 73 of the channel 72. The legs 194, 196 each have a serpentine configuration to define recesses 198, 200 which accept the noses 190 and 192 in two different relative positions between the slide plate 86 and channel 72, corresponding to the upwardmost and neutral positions for the lock bars 56, 58. The slide plate legs 186, 188 are biased towards the channel body 73 so that the noses 190, 192 will spring into the recesses 198, 200. As the noses 190, 192 approach vertical alignment with the recesses 198, 200, the biased legs 186, 188 tend to draw the slide plate 86 and thereby the lock bars 56, 58 into each of the upwardmost and neutral positions therefor. Because the legs 194, 196 are more inflexible in the region where they connect to the channel body 73, the noses 190, 192 are more positively biased into the upper recesses 198. Thus, if there is a tolerance problem, the slide plate will gravitate towards the position corresponding to the neutral lock bar position so that the drawers can be opened.

To increase the bias on the legs 186, 188, a wire spring 202 is attached to the slide plate 86. The wire spring 202 is formed by bending a wire to define at least one coil 204 with biasing legs 206, 208 extending oppositely away from the coil 204. The coil 204 nests in a recess 210 on the slide plate 86. With the coil 204 in recess 210, the legs 206, 208 are loaded and placed in recesses 212, 214 in legs 190, 192 respectively. The spring 202 assures that the slide plate 86 is held positively relative to the channel 72 at its upper extreme of travel and its neutral position. This obviates having to extend the passageways 154, 158 in the ramp plates 136, 138 along the entire length of the drawers.

To further guide and limit movement of the slide plate 86 relative to the channel 72, a post 216 is provided on the slide plate 86 and is guidingly received in an oval guide slot 218 in the channel 72.

A further aspect of the invention is the provision of structure to prevent jamming of the locking system in the event that the drawers 36, 38, 40, 42 are closed and the cabinet 10 is jolted, as upon being dropped, so that the lock bars 56, 58 move into a locked position. This condition is shown in FIGS. 7E and 8E with the pin 108 at the bottom of the cross bar leg 112 in each Figure. Normally, closing of the open drawer would reposition the pin 108 from the FIG. 7E and 8E positions into the neutral position of FIGS. 7B and 8B. However, because the drawers are all closed, this cannot occur. To overcome this problem, flexible tabs 220, 222 are provided on the slide plate 86. The tabs 220, 222 have wedge-shaped surfaces 224, 226, respectively, which permit the pin 108 to pass beneath the tabs 220, 222 and progressively bias the tabs outwardly until the FIGS. 7A and 8A positions can be realized. That is, the pin 108 in FIG. 8E moves from its solid line position under the tab 222 to the phantom position upon rotation of the crank element 98 in a counterclockwise direction. In FIG. 7E, the pin 108 moves from the solid line position under the tab 220 into the phantom position by rotation of the crank element 98 in a clockwise direction relative to the slide plate 86.

The foregoing detailed description was made for purposes of demonstrating the inventive structure and the basic operation thereof, with no unnecessary limitations to be understood therefrom.

We claim:

1. In a piece of furniture having a cabinet with first and second drawers each selectively slidable relative tot he cabinet between an open position and a closed position, the improvement comprising:

a lock bar;

means for mounting the lock bar to the cabinet for translatory movement relative to the cabinet in first and second opposite directions between first and second positions; and cooperating means on the lock bar and first and second drawers for preventing simultaneous movement of said first and second drawers from their closed position to their open position, said coopereating means including (a) interacting means on the lock bar and first drawer for moving the lock bar to the first position as an incident of the first a drawer being moved from its closed position to its open position with the second drawer in its closed position and (b) interacting means on the lock bar and second drawer for moving the lock bar to the second position as an incident of the second drawer being moved from its closed position to its open position with the first drawer in its closed position.

2. In a piece of furniture having a cabinet with first and second drawers each selectively slidable relative to the cabinet between an open position and a closed position, the improvement comprising:

a lock bar;

means for mounting the lock bar to the cabinet for translatory movement relative to the cabinet in first and second opposite directions between first and second positions; and cooperating means on the lock bar and first and second drawers for preventing simultaneous movement of said first and second drawers from their closed position to their open position, wherein said cooperating means comprises first and second lugs on the lock bar and first and second ramp plates on the first and second drawers respectively, each said ramp plate having a ramp surface and a blocking surface, one of said lugs residing in the path of one of the ramp surfaces on one of the ramp plates upon one drawer carrying the one ramp plate being moved from its closed position towards its open position with the other drawer in its closed position and thereby causing the lock bar to be deflected into its first position wherein the other of the lugs blocks the blocking surface on the other of the ramp plates on the other drawer to prevent opening of the other drawer, the other lug residing in the path of the other ramp surface on the other ramp plate upon the other drawer being moved from its closed position towards it open position with the one drawer int he closed position and thereby causing the lock bar to be deflected into its second position wherein the one lug blocks the blocking surface on the one ramp plate to prevent opening of the one drawer.

3. In a piece of furniture having a cabinet with first and second drawers each selectively slidable relative to the cabinet between an open position and a closed position, the improvement comprising:

a lock bar;

means for mounting the lock bar to the cabinet for movement relative to the cabinet in first and second opposite directions between first and second positions;

cooperating means on said first drawer and lock bar for moving the lock bar in said first direction into said first position as an incident of said first drawer being moved from its closed position to its open position with the second drawer in its closed position; and cooperating means on said second drawer and lock bar for moving the lock bar in said second direction into said second position as an incident of said second drawer being moved from its closed position to its open position with the first drawer in its closed position, said cooperating means on said first drawer and lock bar including means for preventing the first drawer from being moved from its closed position to its open position with the second drawer in its open position, said cooperating means on said second drawer and lock bar including means for preventing the second drawer from being moved from its closed position to its open position with the second drawer in its open position.

4. The improved furniture piece according to claim 3 wherein said mounting means for the lock bar mounts the lock bar for translatory movement in a substantially vertical line between said first and second positions.

5. The improved furniture piece according to claim 3 wherein said cooperating means on the first drawer and lock bar comprises a first lug on the lock bar and a ramp plate on the first drawer having a ramp surface, said first lug with the first and second drawers closed residing in the path traversed by the ramp surface as the first drawer is moved from its closed position to its open position and being deflected by said ramp surface so as to thereby move the lock bar into said first position as the first drawer is moved from its closed position to said open position and the cooperating means on the second drawer and lock bar comprises a second leg on the lock bar and a ramp plate on the second drawer having a ramp surface, said second lug with the first and second drawers closed residing in the path traversed by the ramp surface on the second drawer as the second drawer is moved from the closed position to its open position and being deflected by the ramp surface on the second drawer so as to thereby move the lock bar into the second position as the second drawer is moved from its closed position to its open position.

6. The improved furniture piece according to claim 3 wherein said means for preventing the first drawer from being moved comprises a lug on the lock bar and a blocking surface on the first drawer, said lug abutting the blocking surface to prevent the first drawer from being moved from its closed position to its open position with the lock bar in its second position and the means for preventing the second drawer from being moved comprises a second lug on the lock bar and a second blocking surface on the second drawer, said second lug abutting the second blocking surface to prevent the second drawer from being moved from its closed position to its open position with the lock bar in its first position.

7. The improved furniture piece according to claim 3 including means for selectively locking the position of the lock bar to thereby prevent opening of the drawers and unlocking the lock bar to permit movement of the lock bar between said first and second positions thereof in response to said drawers being opened.

8. The improved furniture piece according to claim 7 wherein said locking means comprises a slide plate, channel means for guiding movement of the slide plate in a reciprocative path between a locked position and an unlocked position, means for connecting the lock bar to the slide plate so that the lock bar follows reciprocative movement of the slide plate between a neutral position between the first and second position for the lock bar corresponding to the unlocked position for the slide plate and one of its first and second positions corresponding to the locked position for the slide plate, a crank element, means for mounting the crank element to the channel means for rotation about a first axis, a pin on the crank element spaced from the first axis, said slide plate having a T-shaped slot consisting of a stem leg and a cross-bar leg in which said pin is guided, said pin residing at the juncture of said slot legs with the slide plate in its unlocked position and residing in the stem leg with the slide plate in its locked position, said pin traveling in opposite directions in said slot cross bar in response to movement of said lock bar in said first and second directions between said first and second lock bar positions.

9. The improved furniture piece according to claim 8 wherein cooperating means are provided on the crank element and slide plate for permitting rotation of the crank element relative to the slide plate without moving the slide plate with the lock bar in one of its first and second positions and both drawers closed, to thereby prevent jamming of the locking means.

10. The improved furniture piece according to claim 8 wherein cooperating means are provided on the slide plate and channel means for maintaining the lock bar in each of the first and second positions therefor.

11. The improved furniture piece according to claim 10 wherein the cooperating means on the channel means is integrally formed with the channel means.

12. The improved furniture piece according to claim 11 wherein the cooperating means on the channel means comprises an integrally formed recess and the cooperating means on the slide plate comprises a bendable leg for nesting in the recess with the lock bar in one of its first and second positions.

13. The improved furniture piece according to claim 12 including means for biasing the leg into the recess with the lock bar in one of its first and second positions.

14. In a piece of furniture having a cabinet with first, second and third drawers each having opposite sides and selectively slidable relative to the cabinet between an open position and a closed position, the improvement comprising:

first and second lock bars;

means for mounting each of the lock bars to the cabinet for vertical translatory movement in opposite directions between first and second positions, said lock bars each having a neutral position between its first and second positions with said first, second and third drawers all in their closed positions;

first, second and third lugs on the first lock bar;

third, fourth and fifth lugs on the second lock bar;

a ramp plate on each of the opposite sides of the first, second and third drawers for cooperating with one of said lugs, each said ramp plate having a blocking surface;

means on each of a first plurality of said ramp plates for deflecting one lug and thereby the lock bar carrying the one lug from its neutral position to its first position;

means on each of a second plurality of said ramp plates for deflecting a single lug and thereby the lock bar carrying the single lug from its neutral position to its second position;

each said lug residing in the path of the blocking surface on one ramp plate as the drawer carrying the one ramp plate is moved from its closed position to its open position to prevent movement of the drawer having the one ramp plate from its closed position to its open position with the lock bar carrying each said lug in one of its first and second positions;

said first and second plurality of ramp plates being arranged on the drawers such that upon one of the first, second and third drawers being moved from its closed position to its open position the blocking surface on at least one of the ramp plates on the other two of the drawers is blocked by a lug on one of the lock bars to thereby prevent movement of either of the other two of the drawers from its closed position to their open position.

* * * * *